US009297605B2

(12) United States Patent
Spurlock

(10) Patent No.: US 9,297,605 B2
(45) Date of Patent: Mar. 29, 2016

(54) PAINTBALL DRIVE SYSTEM OF A PAINTBALL LOADER

(71) Applicant: GI Sportz, Inc., St. Laurent (CA)

(72) Inventor: Michael S. Spurlock, Tainan (TW)

(73) Assignee: G.I. Sportz, Inc., St. Laurent, Quebec ( * ) Notice: Subject to any disclaimer, the term of this patent is extended or adjusted under 35 U.S.C. 154(b) by 0 days.

(21) Appl. No.: 14/285,816

(22) Filed: May 23, 2014

(65) Prior Publication Data

US 2015/0338185 A1 Nov. 26, 2015

(51) Int. Cl.
*F41B 11/53* (2013.01)
*F41B 11/71* (2013.01)

(52) U.S. Cl.
CPC ..... *F41B 11/53* (2013.01); *F41B 11/71* (2013.01)

(58) Field of Classification Search
CPC ..... F41B 7/00; F41B 11/71
USPC ..... 124/51.1, 48; 446/73
See application file for complete search history.

(56) References Cited

U.S. PATENT DOCUMENTS

| | | | | | |
|---|---|---|---|---|---|
| 5,816,232 | A * | 10/1998 | Bell | F41B 11/53 | 124/48 |
| 7,854,220 | B1 * | 12/2010 | Neumaster | F41B 11/53 | 124/51.1 |
| 8,047,190 | B2 * | 11/2011 | Kaakkola | F41B 11/53 | 124/1 |
| 2009/0178659 | A1 * | 7/2009 | Spicer | F41B 11/53 | 124/51.1 |
| 2010/0126485 | A1 * | 5/2010 | Neumaster | F41B 11/57 | 124/51.1 |

* cited by examiner

*Primary Examiner* — Gene Kim
*Assistant Examiner* — Jeffrey Vanderveen
(74) *Attorney, Agent, or Firm* — Craig R. Rogers; Simple IP Law, P.C.

(57) ABSTRACT

A paintball drive system of a paintball loader and includes a board having a hole with which a driving ring is engaged. A gear ring is connected to the driving ring. A friction ring is located at the inside of the gear ring. A base is located beneath the board and has a cone which has an outlet and an entrance. A power unit is connected to one end of the loader and rotates the gear ring. The paintballs are received in the paintball loader and is moved by the friction ring which is driven by the gear ring to guide the paintballs to move through the entrance and be fed into the paintball gun via the outlet.

20 Claims, 7 Drawing Sheets

PAINTBALL DRIVE SYSTEM OF A PAINTBALL LOADER

BACKGROUND OF THE INVENTION

1. Fields of the Invention

The present invention relates to a paintball drive system, and more particularly, to a paintball drive system of a paintball loader.

2. Descriptions of Related Art

The paintball guns use a paintball loader to feed the paintballs so as to shoot continuously. The paintballs are ejected from the paintball gun by high pressurized air which is provided by a high-pressure bottle. Generally, the paintball loader is attached on the top of the paintball gun and the paintballs are fed into the paintball gun one by one by a drive system in the paintball loader. The drive system comprises a disk with an inclined ramp and at least one plate is located on the ramp. The disk is driven by a motor and the paintballs are shifted by the plate toward the passage, and the paintballs enter into the gun one by one. The paintballs have a flexible and thin coat and paint is filled in the paintball. However, the paintballs may not be precisely moved as expected and/or the coat is broken during movement of the paintballs. Paintball jam becomes a major problem for the players.

The present invention intends to provide a paintball drive system of a paintball loader, and the paintball drive system of the present invention eliminate the shortcomings mentioned above.

SUMMARY OF THE INVENTION

The present invention relates to a paintball drive system of a paintball loader. The paintball drive system is located in the paintball loader which has a top casing and a bottom casing. The paintball drive system comprises a board having a hole, and an inclined ramp extends from the periphery of the hole. A power unit is connected to one end of the board. A base is located at the underside of the board and located corresponding to the hole. A room is formed in the top of the base and a cone extends from the top of the base. An outlet is defined through a center of the cone and a paintball way is formed along the periphery of the cone and communicates with the room. The cone has an entrance which communicates with the outlet and the paintball way. A cover is engaged with the outlet. A gear ring is located in the room of the base and has teeth defined in the outside thereof. The power unit is engaged with the teeth to rotate the gear ring. A friction ring is located at the inside of the gear ring so as to push the paintballs toward the entrance. A driving ring is connected to the gear ring and rotated by the gear ring so as to move the paintballs.

Preferably, the board has two wings respectively extending from two sides thereof, and each of the two wings has an engaging edge which is connected to the top and bottom casings.

Preferably, the friction ring is made by multiple duraometer silicone and has multiple protrusions extending at equal distance from the inner periphery thereof so as to move the paintballs.

Preferably, the power unit has a power source and at least one transmission member. The power source has an output shaft which rotates the at least one transmission member which is engaged with the teeth of the gear ring so as to rotate the gear ring.

Preferably, a first sensor is located beneath the inclined ramp and detects the paintball in the paintball loader.

Preferably, the power unit has a first gear and a second gear whose teeth are less than those of the first gear. The output shaft of the power source is engaged with the first gear which is engaged with the second gear. The second gear is engaged with the teeth of the gear ring.

Preferably, a second sensor is located at the outlet of the base and detects the paintballs to pass the outlet.

Preferably, the first and second sensors are electrically connected to each other.

Preferably, a non-touch sensor is connected to a root portion of the paintball loader. The non-touch sensor activates or shuts off electric power by way of non-physical touch.

Preferably, the first and second sensors are infrared sensors.

The primary object of the present invention is to provide a paintball drive system of a paintball loader, wherein the paintballs are smoothly fed into the paintball gun and are not broken during feeding.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
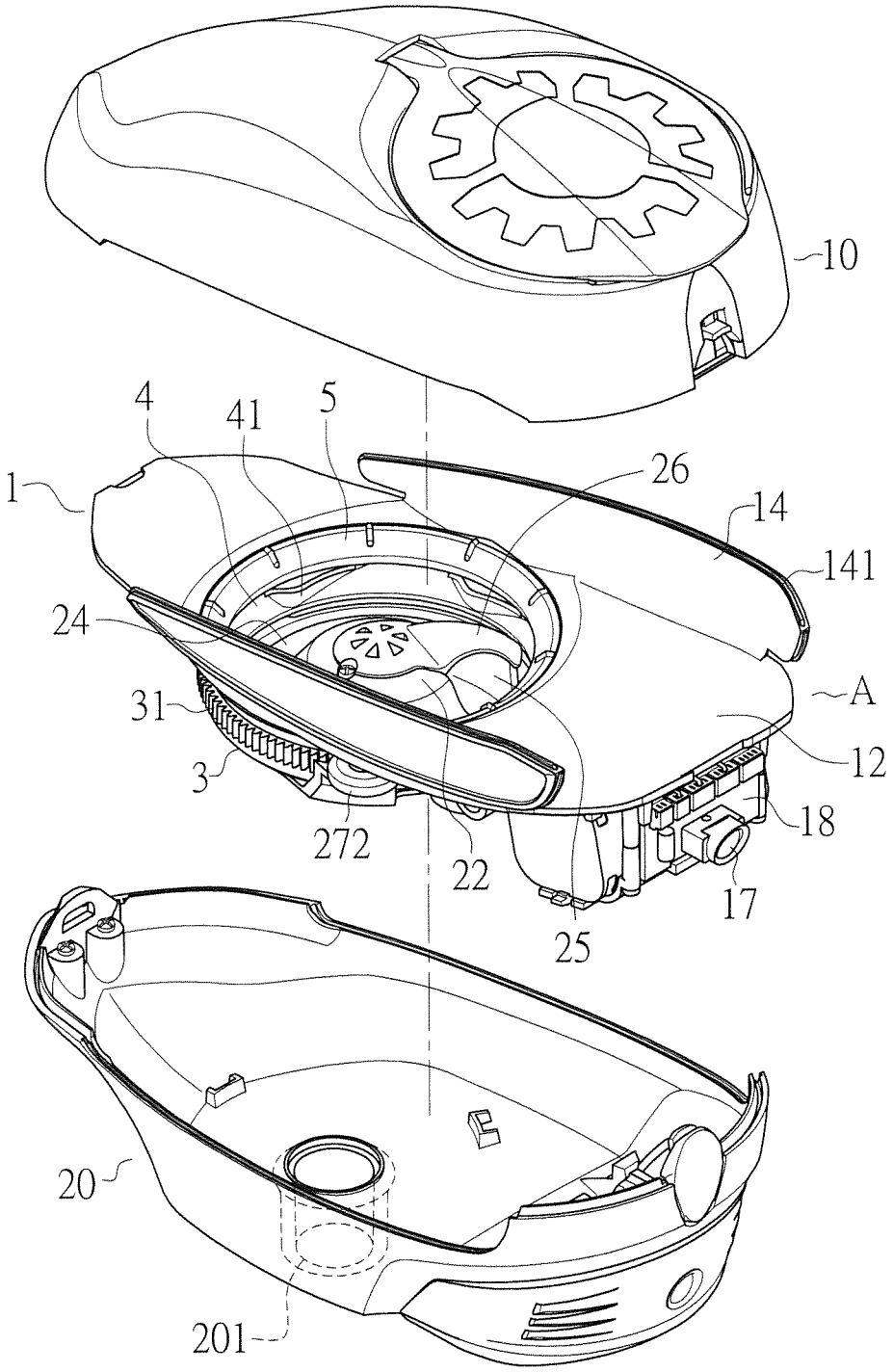
FIG. 1 is an exploded view of the paintball loader of the present invention.
Figure 2:
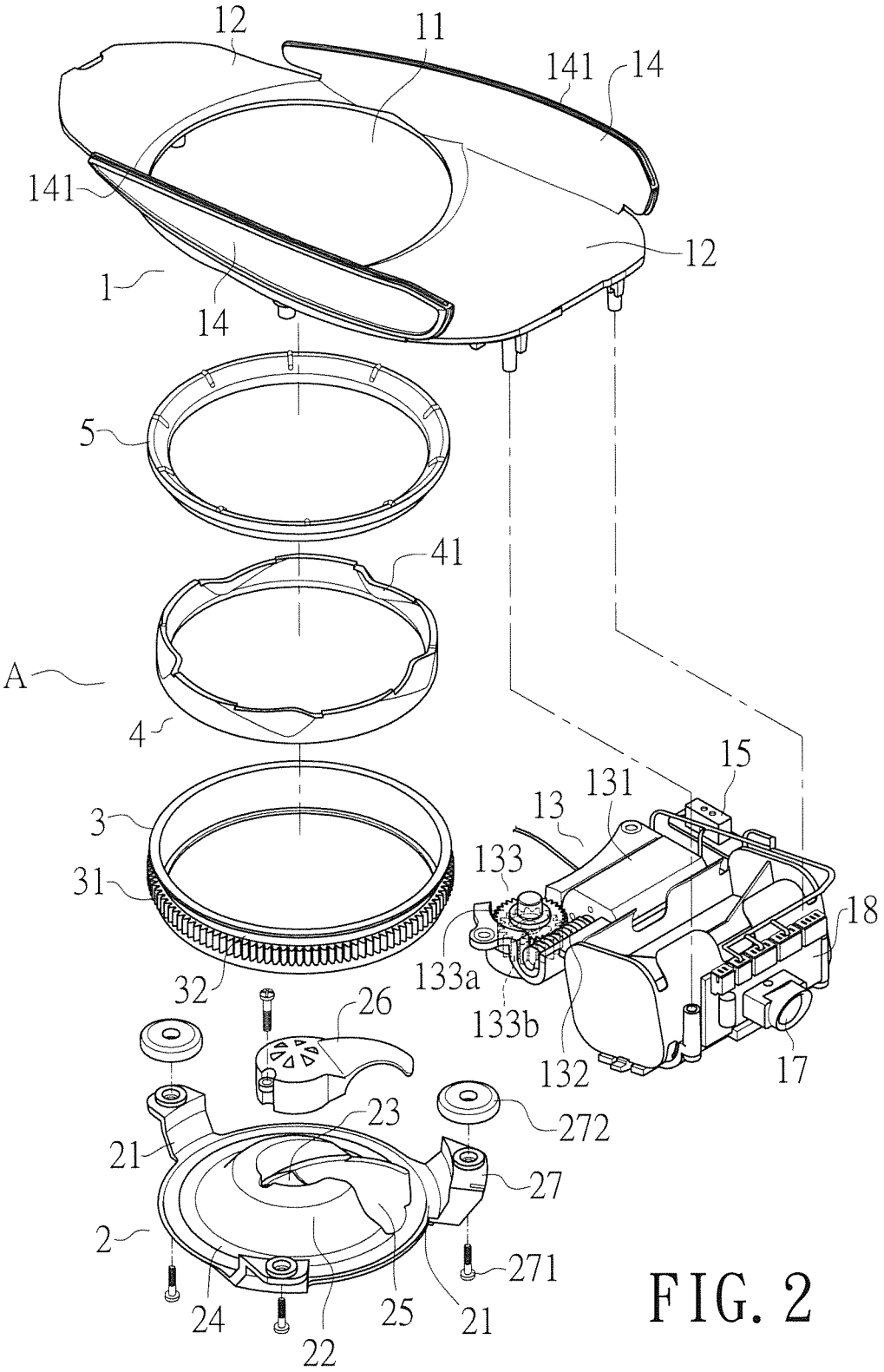
FIG. 2 is an exploded view of the paintball drive system of the paintball loader of the present invention.

Referring to FIGS. 1 to 2, the paintball loader of the present invention comprises a top casing 10 and a bottom casing 20, and the paintball drive system "A" is located between the top and bottom casings 10, 20.

The paintball drive system "A" of the present invention comprises a board 1 having a hole 11 defined therethrough, and an inclined ramp 12 extending from the periphery of the hole 11. A power unit 13 is connected to one end of the board 1.

A base 2 is located at the underside of the board 1 and located corresponding to the hole 11. A room 21 is formed in the top of the base 2. A cone 22 extends from the top of the base 2 and an outlet 23 is defined through the center of the cone 22. A paintball way 24 is formed along the periphery of the cone 22 and communicates with the room 21. The cone 22 has an entrance 25 which communicates with the outlet 23 and the paintball way 24. A cover 26 is engaged with the outlet 23. Multiple connection members 27 extending from the base 2 so as to be connected with the board 1 by locking members 271. Each of the connection members 27 has a roller 272 connected thereto. These rollers 272 are located beneath the board 1.

A gear ring 3 is located in the room 21 of the base 2 and has teeth 31 defined in the outside thereof. The power unit 13 is engaged with the teeth 31 to rotate the gear ring 3. An annular groove 32 is defined in the outside of the gear ring 3 and located above the teeth 31, the rollers 272 move along the annular groove 32.

A friction ring 4 is located at the inside of the gear ring 3 so as to push the paintballs toward the entrance 25 by multiple protrusions 41 extending at equal distance from the inner periphery thereof.

A driving ring 5 is connected to the gear ring 3 and rotated by the gear ring 3 in the hole 11 to move the paintballs.

As shown in FIGS. 1 to 7, the board 1 has two wings 14 respectively extending from two sides thereof, and each of the two wings 14 has an engaging edge 141 which is connected to the top and bottom casings 10, 20. The bottom casing 20 has a path 201 which is in communication with the outlet 23. The top and bottom casings 10, 20 are easily connected to the engaging edge 141 of the board 1 easily and does not need any tool.

When in use, the paintballs are located in the room between the board 1 and the top casing 10, the paintballs enter the hole 11 and located on the paintball way 24. The paintballs in the base 2 contact a non-action surface (the paintball way 24) and move by friction along a guiding face which is the friction ring 4 and the driving ring 5. The paintballs are loaded in the room between the cone 22, the friction ring 4 and the paintball way 24. The paintballs are detected by the first sensor 15 which is electrically connected with a control circuit 18. The control circuit 18 activates the power source 131 of the power unit 13, the output shaft 132 of the power source 131 drives at least one transmission member 133 which is engaged with the teeth 31 of the gear ring 3 so that the gear ring 3 is rotated. The motor of the control circuit 18 controls the revolutions per minute (R.P.M.) of the power source. In one preferable embodiment, the power unit 13 has a first gear 133*a* and a second gear 133*b* whose teeth are less than those of the first gear 133*a*. The output shaft 132 of the power source 131 is engaged with the first gear 133*a* which is engaged with the second gear 133*b*, the second gear 133*b* is engaged with the teeth 31 of the gear ring 3. By this arrangement, a gear reduction unit is formed.

When the gear ring 3 rotates, the friction ring 4 and the driving ring 5 are rotated. The paintballs are driven to roll along the paintball way 24 by the friction provided by the friction ring 4 and the driving ring 5.

When the gear ring 3 rotates clockwise and the paintballs roll along the paintball way 24. Each of the paintballs rolls along a fixed surface which is the paintball way 24, and a movable surface which is the friction ring 4 or the driving ring 5. The paintballs are moved toward the cone 22 and reach the cover 26 by the friction ring 4. The cover 26 guides the paintballs to the outlet 23 so that the paintballs enter into the path 201. When the paintballs reach the cover 26 and the entrance 25, because the entrance 25 and the paintball way 24 are two different faces joint together, so that the paintballs are temporally stopped at the conjunction area between the entrance 25 and the paintball way 24, and then forced pushed by the following paintballs and drop into the path 201.

Figure 5:
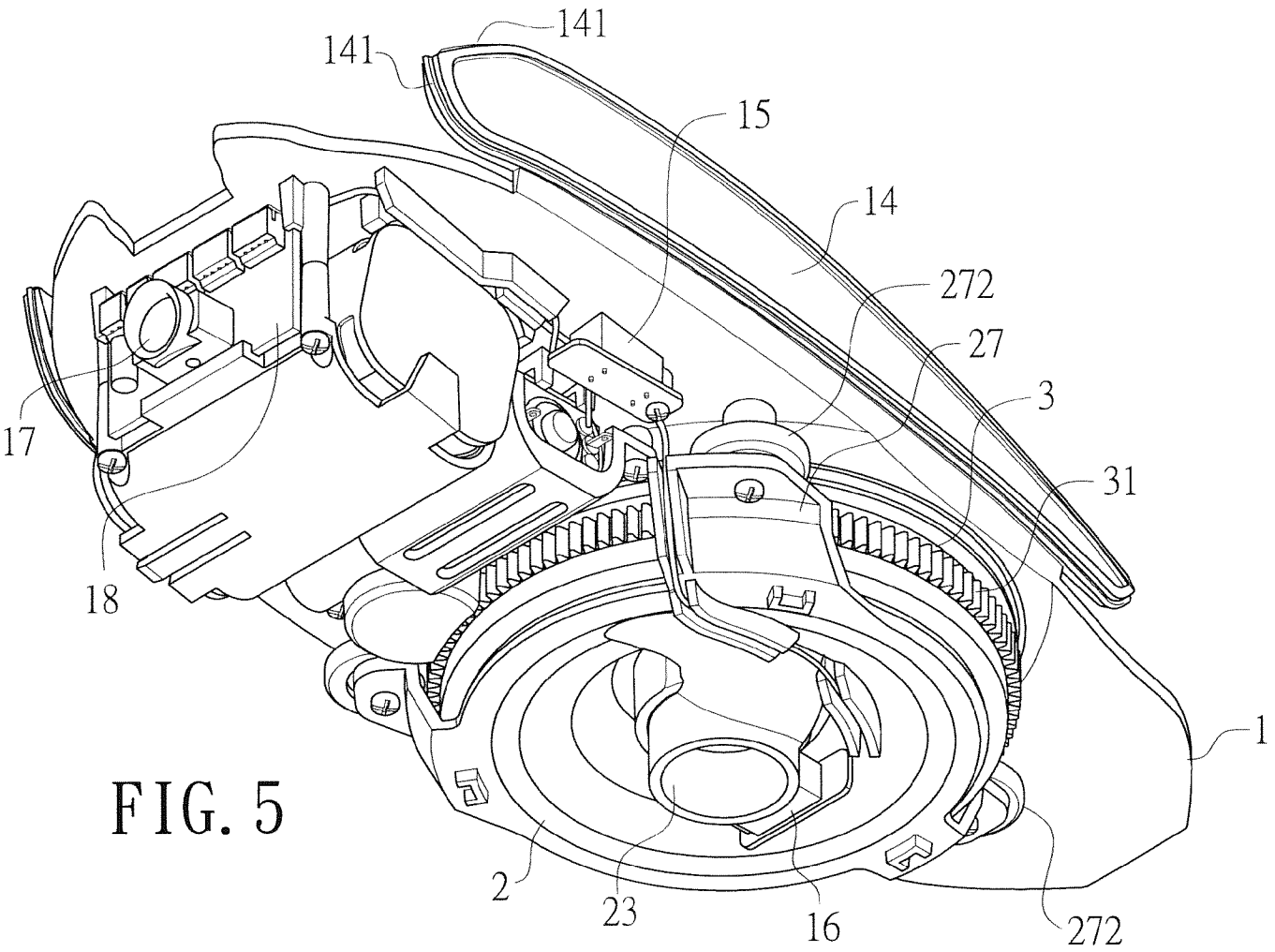
FIG. 5 is a perspective view, viewed from the underside of the paintball loader of the present invention.
Figure 6:
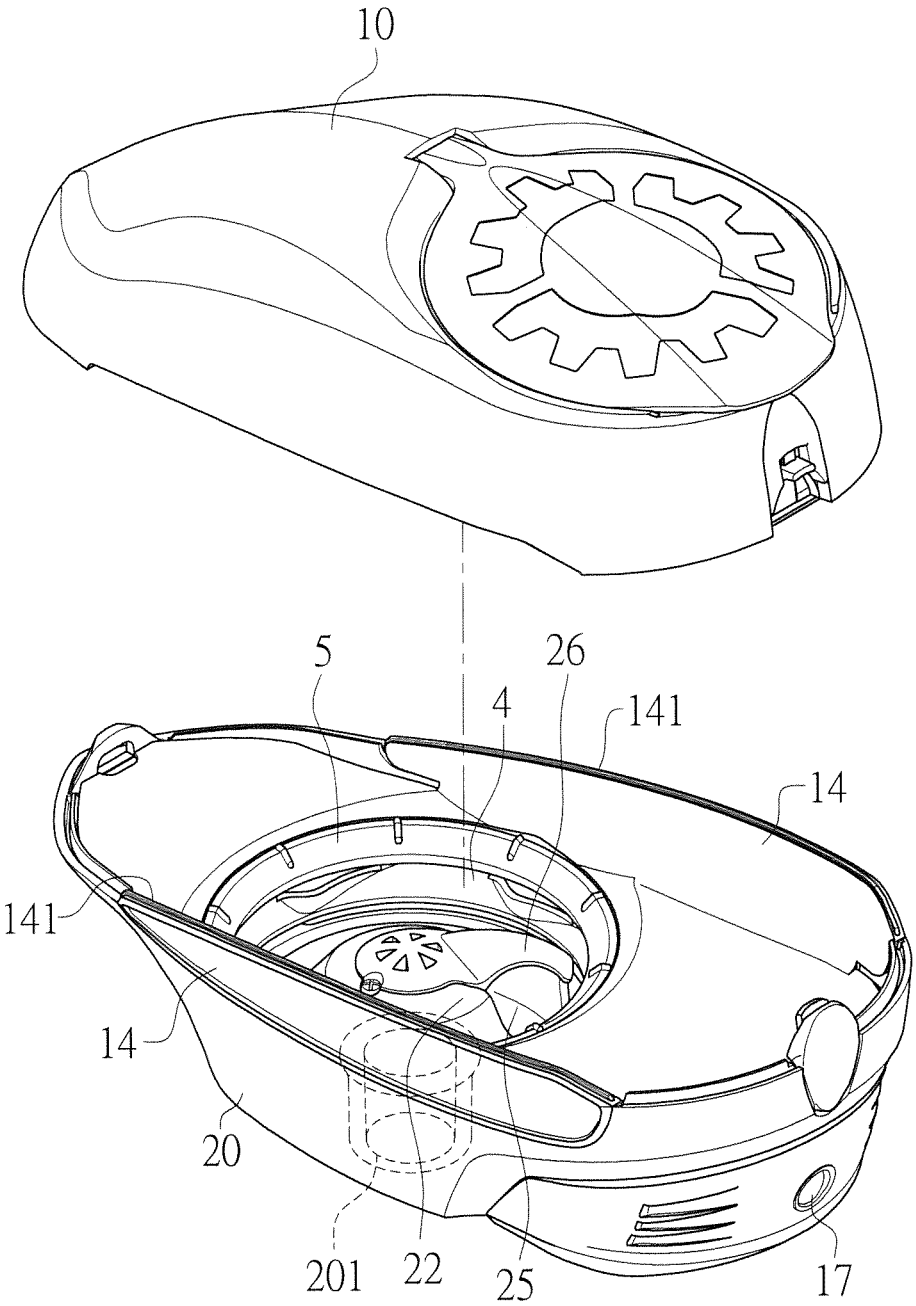
FIG. 6 shows that the top casing is to be connected to the paintball loader of the present invention.
Figure 7:
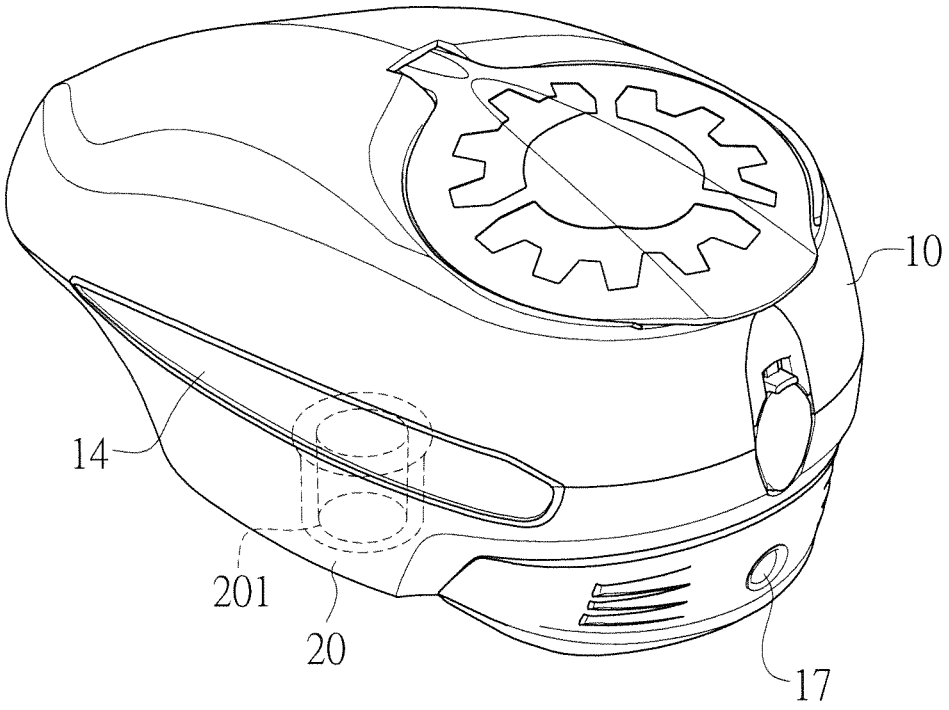
FIG. 7 is a perspective view to show the paintball loader of the present invention.

As shown in FIG. 5, as known, the paintball gun shoots 30 to 40 paintballs per second, so that the present invention provides a device to let the player know the timing for replacing a new paintball. Therefore, the first sensor 15 is located under the ramp 12 and the first sensor 15 can be an infrared sensor. A second sensor 16 is located at the outlet 23 of the base 2 so as to detect the paintballs passing the outlet 23. The second sensor 16 can be an infrared sensor. The first and second sensors 15, 16 are electrically connected to the control circuit 18. By detecting the paintballs, the power source can be activated or shut off, or a new paintball is replaced.

Figure 3:
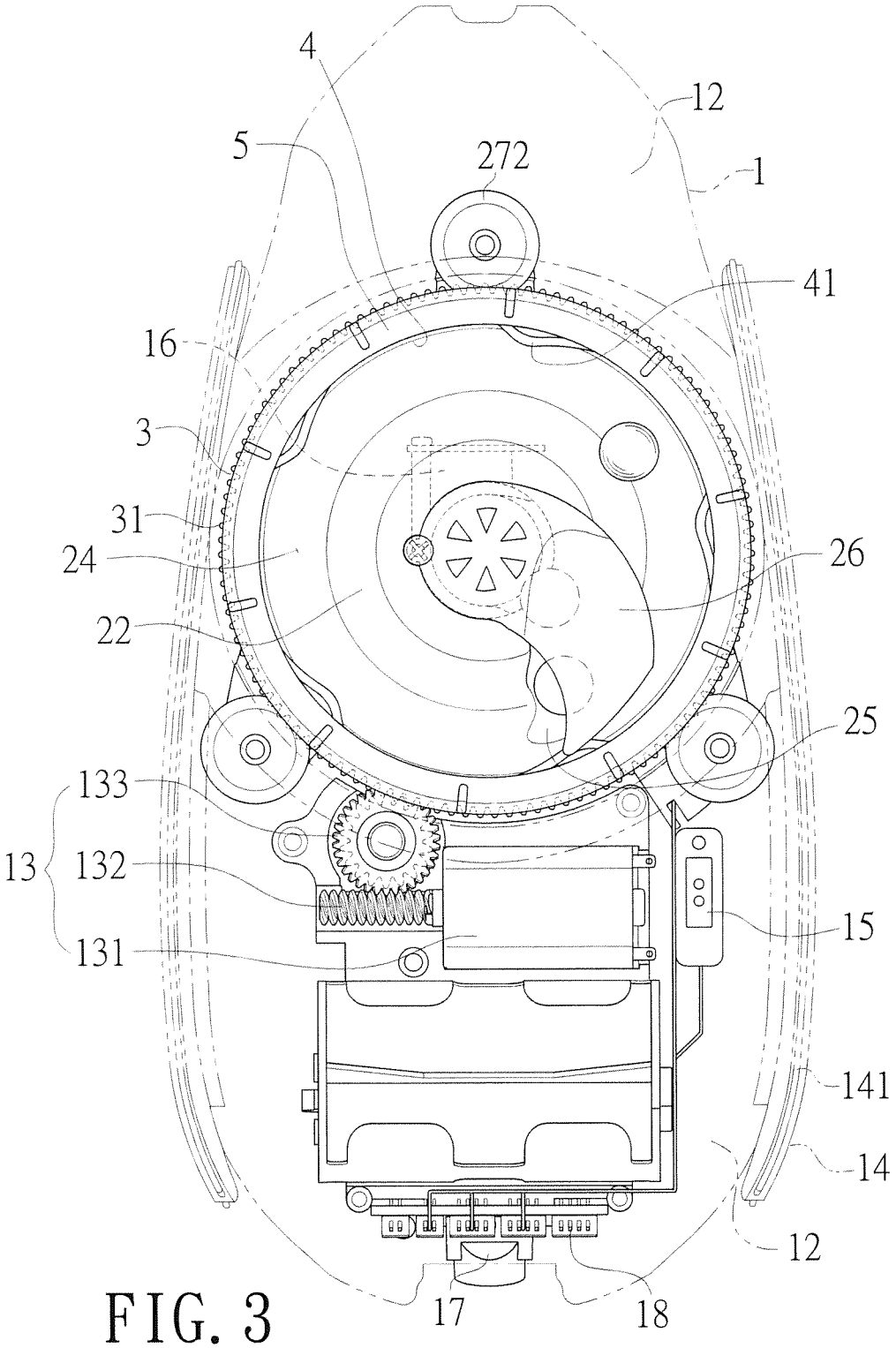
FIG. 3 is a top view to illustrate the position relationship of the parts of the paintball drive system of the paintball loader of the present invention.
Figure 4:
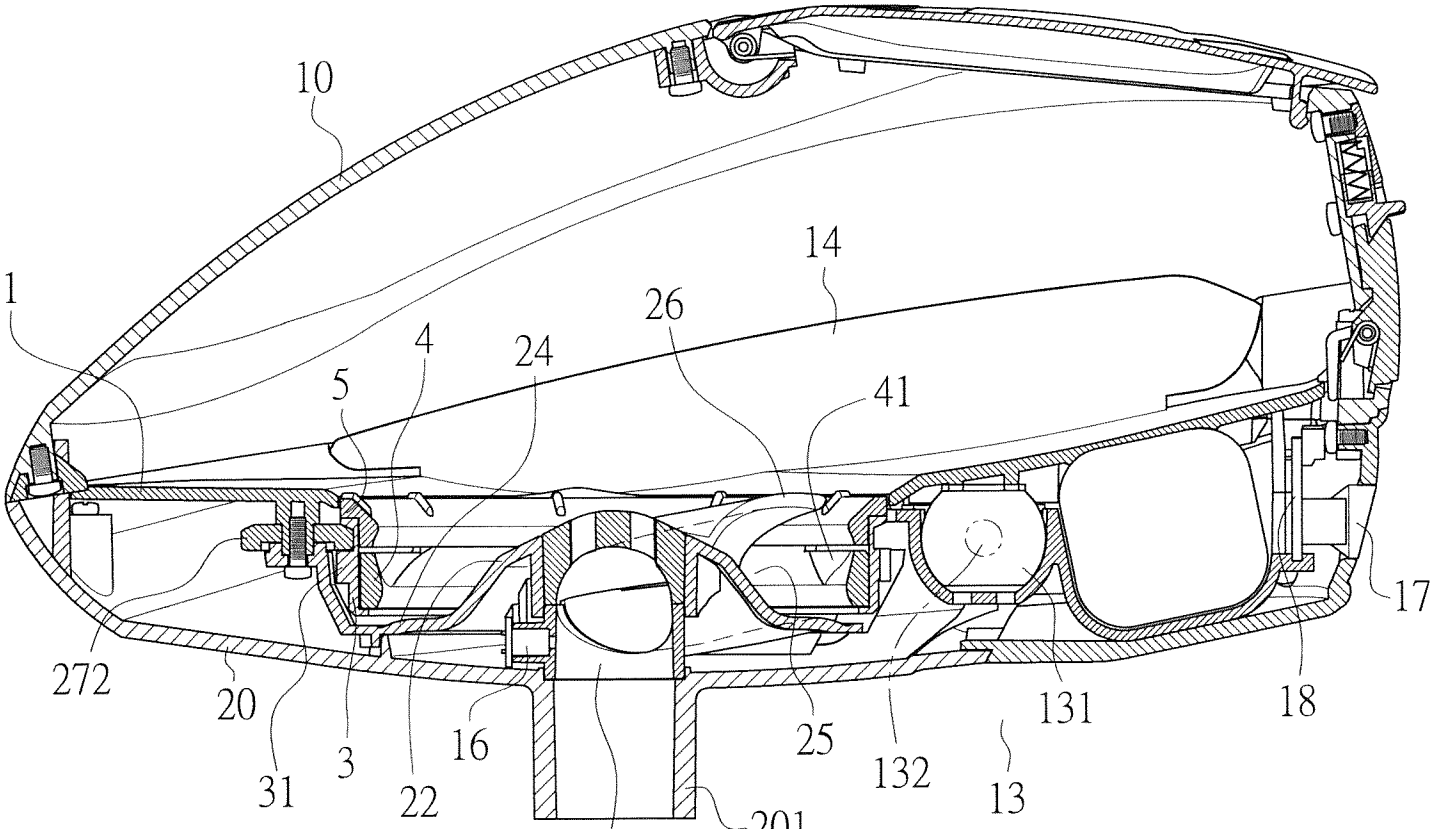
FIG. 4 is a side cross sectional view of the paintball loader of the present invention.

As shown in FIGS. 3 to 5, when the second sensor 16 detects no paintball or the paintballs do not move, a signal is sent to the first sensor 15 which judges the absence or presence of the paintball and the power source 131 is shut off via the control circuit 18. The paintball loader stops the operation. When the paintballs are loaded into the paintball loader, the first sensor 15 detects the paintballs and the power source 131 is activated via the control circuit 18, the paintballs in the paintball loader enter into the entrance 25 via the paintball way 24 until the second sensor 16 detects the paintballs reach the outlet 23.

By the cooperation of the first and second sensors 15, 16, the player is acknowledged the status of the paintball loader, and when there is a jam, the second sensor 16 sends a signal to the control circuit 18 to rotate the power source reversely, when the jam is cleared, the paintballs are fed normally again.

Besides, there is a non-touch sensor 17 connected to the root portion of the paintball loader, the non-touch sensor 17 is a non-physical-touch sensor which needs not to be physically touched by an object to activate or shut off the electric power. The "ON" and "OFF" operation of the paintball loader simply inserting a finger into an area where a power icon is marked, the finger swings or move to activate or shut off the power via the non-touch sensor 17.

The friction ring 4 is made by multiple duraometer silicone and provides friction to let the paintballs to roll on the paintball way 24 of the base 2, so that the paintballs are not broken.

The paintballs smoothly and quickly roll on the paintball way 24 of the base 2 so that the paintball gun can shoot continuously without jam.

The connection between the first and second casings 10, 20 and the wings are easy and quick without use of any tool.

The player is signaled via led the status of the paintball loader by the cooperation of the first and second sensors 15, 16. The player can reload efficiently.

The present invention provides a non-physical-touch sensor on the surface of the root portion of the paintball loader so that the player can activate or shut off the power quickly.

While we have shown and described the embodiment in accordance with the present invention, it should be clear to those skilled in the art that further embodiments may be made without departing from the scope of the present invention.

What is claimed is:

1. A paintball drive system of a paintball loader, the paintball drive system located in a paintball loader which has a top casing and a bottom casing, the paintball drive system comprising:

a floor board having a hole defined therethrough, said floor board including an inclined ramp extending from a periphery of the hole to provide a floor for a chamber arranged between the top casing and the bottom casing;

a power unit mounted to an end of the floor board;

a non-rotating base located at an underside of the floor board at a position corresponding to the hole, a room being formed in a top of the base and configured to contain a quantity of paintballs therein, said base including a non-rotating cone extending from the top of the base at a center portion of the room, an outlet defined below a center of the non-rotating cone, a paintball way formed along a periphery of the non-rotating cone and communicating with the room, and a cover covering the outlet, said cover connected to the cone and providing an arm to catch and direct paintballs into the paintball way, wherein the non-rotating cone includes an entrance communicating between the paintball way and the outlet;

a gear ring located in the room of the base and having teeth defined along an outside periphery thereof, the power unit engaged with the teeth to rotate the gear ring completely around the non-rotating cone;

a friction ring located at an inside of the gear ring and adapted to rotate around the non-rotating cone along with the gear ring, said friction ring having multiple protrusions extending toward but not contacting the non-rotating cone, said protrusions configured to push the paintballs in the room toward the entrance as the friction ring is rotated; and a driving ring connected to the gear ring and configured to rotate with the gear ring so as to move the paintballs toward the entrance using a frictional force between the driving ring and the paintballs.

2. The paintball drive system as claimed in claim 1, wherein the board has two wings respectively extending from two opposite sides thereof, wherein each of the two wings has an engaging edge which is adapted to be connected to the top and bottom casings.

3. The paintball drive system as claimed in claim 1, wherein the friction ring comprises multiple duraometer silicone and wherein the multiple protrusions extend only a small portion of the distance between the friction ring and the non-rotating cone.

4. The paintball drive system as claimed in claim 1, wherein the power unit has a power source and at least one transmission member engaging the teeth of the gear ring, wherein the power source has an output shaft configured to rotate the at least one transmission member to rotate the gear ring.

5. The paintball drive system as claimed in claim 1, wherein a first sensor is located beneath the inclined ramp and is adapted to detect the absence or presence of paintballs in the chamber above the floor board.

6. The paintball drive system as claimed in claim 4, wherein the power unit comprises a first gear having teeth engaged with teeth of a second gear, wherein the second gear has fewer teeth than the first, wherein the output shaft of the power source is engaged with the first gear, and wherein the teeth of the second gear are engaged with the teeth of the gear ring.

7. The paintball driving system as claimed in claim 5, wherein a second sensor is located near the outlet of the base and is adapted to detect paintballs passing through the outlet.

8. The paintball drive system as claimed in claim 7, wherein the first and second sensors are electrically connected to each other, and wherein the paintball drive system is configured to use information received from both the first and second sensors to determine whether to activate or shut off the power source of the drive system.

9. The paintball drive system as claimed in claim 1, further comprising a non-touch sensor located on the paintball loader and electrically connected to the drive system, wherein the non-touch sensor is configured to activate or shut off electric power to the drive system in response to user actuation of the sensor by way of finger or hand movement in proximity to the non-touch sensor.

10. The paintball drive system as claimed in claim 7, wherein the first and second sensors are infrared sensors.

11. A paintball drive system for a paintball loader, said paintball loader configured to house a quantity of paintballs in a chamber and supply the quantity of paintballs from the chamber to a paintball gun when in operation, said drive system comprising:

an outlet configured to supply paintballs from the chamber to the paintball gun when the loader is operatively connected to the paintball gun;

a non-rotating cone arranged above the outlet and having an opening in a side thereof to provide an entrance;

a paintball way configured to direct paintballs into the outlet from the chamber through the entrance;

a cover connected to the non-rotating cone and having an arm that directs paintballs into the entrance;

a driving ring surrounding the non-rotating cone and configured to rotate around the non-rotating cone, wherein said driving ring is configured to urge paintballs from the chamber into the paintball way and toward the outlet during operation of the drive system.

12. The paintball drive system of claim 11, further comprising a friction ring surrounding and configured to rotate around the non-rotating cone, said friction ring comprising a plurality of protrusions extending only a small portion of the distance from the friction ring toward the non-rotating cone, wherein said protrusions are configured to urge paintballs into the paintball way during operation of the drive system.

13. The paintball drive system of claim 11, further comprising a first sensor configured to detect the presence or absence of paintballs in the paintball chamber, and a second sensor configured to detect the presence or absence of paintballs in the outlet.

14. The paintball drive system of claim 13, wherein the paintball drive system is configured to use information received from both the first sensor and the second sensor to determine whether to actuate the drive system to drive rotation of the driving ring.

15. The paintball drive system of claim 14, wherein the drive system is configured to be actuated only when paintballs are detected in the chamber by the first sensor but no paintballs are detected in the outlet by the second sensor.

16. A paintball loader for use with a paintball gun, said paintball loader configured to supply a quantity of paintballs to the paintball gun through an outlet thereof when operatively connected to the paintball gun, said paintball loader comprising:

a housing comprising a top casing removeably connectable to a bottom casing, wherein the top casing can be removed from the bottom casing without tools;

a chamber formed in the housing between the top casing and the bottom casing;

a floor board configured to provide a floor for the chamber;

a hole arranged through the floor board;

a drive system arranged beneath the floor and configured to receive paintballs through the hole and drive paintballs from the chamber toward an outlet of the paintball loader;

said drive system comprising:

a non-rotating cone arranged above the outlet and having an entrance formed through a side thereof;

a paintball way configured to direct paintballs toward the outlet through the entrance;

a driving ring surrounding the non-rotating cone and configured to rotate around the non-rotating cone to drive paintballs into the paintball way; and a power unit configured to drive the driving ring.

17. The paintball loader as claimed in claim 16, further comprising a friction ring surrounding the non-rotating cone and configured to rotate with the driving ring, said friction ring comprising a plurality of protrusions extending towards but not contacting the non-rotating cone, wherein said protrusions are configured to urge paintballs into the paintball way when the friction ring is rotated.

18. The paintball loader as claimed in claim 16, further comprising a first sensor arranged below the floor and configured to detect the presence or absence of paintballs in the chamber.

19. The paintball loader as claimed in claim 18, further comprising a second sensor arranged proximal to the outlet and configured to detect the presence or absence of a paintball in the outlet, wherein the paintball loader is configured to use information from both the first sensor and the second sensor to determine whether to actuate the power unit.

20. The paintball loader as claimed in claim 19, wherein the paintball loader is configured to actuate the power unit only when paintballs are detected in the chamber by the first sensor but no paintballs are detected in the outlet by the second sensor.

* * * * *